US006879297B2

(12) United States Patent
Brown et al.

(10) Patent No.: US 6,879,297 B2
(45) Date of Patent: Apr. 12, 2005

(54) DYNAMICALLY CHANGING OPERATIONAL BAND OF AN ELECTROMAGNETIC HORN ANTENNA USING DIELECTRIC LOADING

(75) Inventors: Stephen B. Brown, Palm Bay, FL (US); James J. Rawnick, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 70 days.

(21) Appl. No.: 10/637,027

(22) Filed: Aug. 7, 2003

(65) Prior Publication Data

US 2005/0030241 A1 Feb. 10, 2005

(51) Int. Cl.[7] ..... H01Q 13/02
(52) U.S. Cl. ..... 343/786; 343/772; 343/781 R
(58) Field of Search ..... 343/772, 786, 343/779, 781 R, 840, 767, 859

(56) References Cited

U.S. PATENT DOCUMENTS

| | | | | |
|---|---|---|---|---|
| 4,477,816 A | * | 10/1984 | Cho | 343/786 |
| 4,965,869 A | * | 10/1990 | Fortney | 343/781 R |
| 5,162,972 A | | 11/1992 | Gripshover et al. | 361/277 |
| 5,325,105 A | * | 6/1994 | Cermignani et al. | 343/786 |
| 6,515,235 B2 | | 2/2003 | Moller | 174/256 |

OTHER PUBLICATIONS

U.S. Appl. No. 10/369,436, filed Feb. 18, 2003, Rawnick et al.
U.S. Appl. No. 10/387,208, filed Mar. 11, 2003, Rawnick et al.
U.S. Appl. No. 10/330,755, filed Dec. 27, 2002, Rawnick et al.
U.S. Appl. No. 10/330,754, filed Dec. 27, 2002, Rawnick et al.
U.S. Appl. No. 10/300,456, filed Nov. 19, 2002, Rawnick et al.
U.S. Appl. No. 10/361,548, filed Feb. 10, 2003, Rawnick et al.
U.S. Appl. No. 10/387,209, filed Mar. 11, 2003, Rawnick et al.
U.S. Appl. No. 10/439,094, filed May 15, 2003, Rawnick et al.
U.S. Appl. No. 10/387,194, filed Mar. 11, 2003, Brown et al.
U.S. Appl. No. 10/438,435, filed May 15, 2003, Brown et al.
U.S. Appl. No. 10/414,696, filed Apr. 16, 2003, Brown et al.
U.S. Appl. No. 10/414,650, filed Apr. 16, 2003, Brown et al.
U.S. Appl. No. 10/635,629, filed Aug. 6, 2003, Brown et al.
U.S. Appl. No. 10/459,067, filed Jun. 11, 2003, Brown et al.
U.S. Appl. No. 10/438,436, filed May 15, 2003, Rawnick et al.
U.S. Appl. No. 10/626,090, filed Jul. 24, 2003, Brown et al.
U.S. Appl. No. 10/635,582, filed Aug. 6, 2003, Rawnick et al.
U.S. Appl. No. 10/632,632, filed Aug. 1, 2003, Rawnick et al.

(Continued)

*Primary Examiner*—Don Wong
*Assistant Examiner*—Jimmy Vu
(74) *Attorney, Agent, or Firm*—Sacco & Associates, PA

(57) ABSTRACT

The invention concerns a multi-mode electromagnetic horn antenna that can operate over two or more distinct bands of frequencies. The horn (100) includes a throat portion (102) and an aperture (108) disposed at an end of the horn (100) opposed to the throat portion (102). A flared section (104, 106) is disposed between the throat portion and the aperture. At least one dimension of the flared section can increase in size along an axial length of the horn defined between the throat portion (102) and the aperture (108). Further, a dielectric load (103) can be disposed within the throat portion (102). The dielectric load is advantageously comprised a fluid dielectric (103).

31 Claims, 6 Drawing Sheets

OTHER PUBLICATIONS

U.S. Appl. No. 10/614,149, filed Jul. 7, 2003, Brown et al.
U.S. Appl. No. 10/634,219, filed Aug. 5, 2003, Rawnick et al.
U.S. Appl. No. 10/458,859, filed Jun. 11, 2003, Rawnick et al.
U.S. Appl. No. 10/624,378, filed Jul. 22, 2003, Brown et al.
U.S. Appl. No. 10/438,433, filed May 15, 2003, Rawnick et al.
U.S. Appl. No. 10/460,947, filed Jun. 13, 2003, Rawnick et al.
U.S. Appl. No. 10/421,352, filed Apr. 23, 2003, Rawnick et al.
U.S. Appl. No. 10/409,261, filed Apr. 8, 2003, Pike.
U.S. Appl. No. 10/441,743, filed May 19, 2003, Pike.
U.S. Appl. No. 10/628,846, filed Jul. 28, 2003, Pike et al.
U.S. Appl. No. 10/448,973, filed May 30, 2003 Delgado et al.
U.S. Appl. No. 10/300,455, filed Nov. 19, 2002, Brown et al.

* cited by examiner

DYNAMICALLY CHANGING OPERATIONAL BAND OF AN ELECTROMAGNETIC HORN ANTENNA USING DIELECTRIC LOADING

BACKGROUND OF THE INVENTION

1. Statement of the Technical Field

The present invention relates to the field of electromagnetic horn antennas, and more particularly to horn antennas that use dielectric loading.

2. Description of the Related Art

Electromagnetic horn antennas are commonly used to produce a directional RF radiation pattern at microwave frequencies. A horn antenna generally includes a conical or rectangular wall section for transmitting and/or receiving an electromagnetic signal. The wall flares or angles outwardly from a throat section to an aperture and defines an internal surface made out of electrically conductive material. The throat of the microwave horn is typically sized to be comparable to the wavelength being used. Horn radiators may be fed by waveguides, coaxial lines and other feeds.

A horn antenna is an electromagnetic transducer which gradually transforms the wave impedance at the throat of the horn to the impedance of free space at the aperture end. A horn antenna can be viewed as an "improved" waveguide radiator. The simplest waveguide radiator is an open-ended waveguide. The directivity of a waveguide radiator may be increased by enlarging the aperture. This is done by attaching a flare or horn to the waveguide, hence the term tapered horn antenna. The tapered horn antenna is designed to transform a transverse wave at the end of the waveguide to a similar transverse wave at the end of the tapered horn without causing attenuation. The throat of the tapered horn (the junction between the tapered horn and the waveguide) serves as a filter device and allows only a single mode to be propagated freely to the aperture. The tapered horn will not support propagation of a particular mode unless the transverse dimensions of the tapered horn are greater than the dimensions of the waveguide.

The dimensions of the open end of the tapered horn are chosen to obtain the desired radiation pattern and to prevent spherical distortion of the propagated wave. The taper of the horn serves to match the impedance of the waveguide to the impedance of space. At one end, the impedance of the tapered section matches that of space; at the other end, it matches the impedance of the waveguide.

Electromagnetic horn antennas are available in several different configurations including rectangular, pyramidal, and conical designs. The radiating field pattern of the horn will generally be determined by the shape that is selected. Horns with larger mouths tend to have more directive field patterns. The flare angle of the horn largely determines the phase distribution of the fields at the mouth of the horn, which influences the distribution and level of sidelobes in the far field radiation pattern. In general, small flare angles produce the least phase variation and the most desirable patterns. However, the combination of a large mouth and small flare angle leads to a long horn. Horn design requires balancing these parameters against the physical constraints of the application. Structures such as metallic septa or stepped dielectric slabs can also be placed within the horn to change the wave velocity across the horn and thus control phase distribution at the aperture.

One advantage of conventional horn antennas is that they generally will operate reasonably well over a relatively broad range of frequencies. However, increasing demands for wideband and multi-band operational capability have placed even more emphasis on the need for expanding the range of frequencies over which a single horn antenna can be made to operate.

SUMMARY OF THE INVENTION

The invention concerns a multi-mode electromagnetic horn antenna that can operate over two or more distinct bands of frequencies. The horn includes a throat portion and an aperture disposed at an end of the horn opposed to the throat portion. A flared section is disposed between the throat portion and the aperture. At least one dimension of the flared section can increase in size along an axial length of the horn defined between the throat portion and the aperture. Further, a dielectric load can be disposed within the throat portion. The dielectric load is advantageously comprised a fluid dielectric. A fluid management system is provided for selectively controlling the dielectric load to vary a load at least one of a permeability and a permittivity of the dielectric load.

The dielectric load can also be comprised of a gas that is non-reactive with the fluid dielectric. The gas can have a relative permeability and a relative permittivity different from the fluid dielectric. According to another aspect of the invention, the dielectric load can also be comprised of a second fluid dielectric that has electromagnetic properties distinct from the first fluid dielectric. In that case, the first and second fluid dielectrics are preferably immiscible so that the first and second fluid dielectrics are separated by an immiscible fluid interface. The different electromagnetic properties can include one or more of a permeability and a permittivity.

The fluid management system can comprise at least one fluid reservoir and at least one fluid conduit for communicating the fluid dielectrics to the throat portion of the horn. A fluid port provided in the throat portion of the horn can be used to communicate the first fluid dielectric from the conduit to the throat portion. Likewise, a second fluid port can be used to communicate a second fluid dielectric from a second conduit to throat portion.

The fluid dielectric can be comprised of an industrial solvent that can contain a suspension of magnetic particles. The magnetic particles can be formed of a material selected from the group consisting of a metal, ferrite, metallic salts, and organo-metallic particles. The horn antenna can also include an electromechanical device for selectively controlling the dielectric load in response to a control signal. For example an electromechanical fluid actuator can be used to move the fluid dielectric into and out of the throat of the horn.

The invention can also include a method for selectively varying a cutoff frequency of an electromagnetic horn antenna. The method can include the steps of dielectrically loading the horn with a dielectric load comprising a first fluid dielectric and selectively controlling the dielectric load by varying at least one of a dielectric load permeability and a load permittivity. The controlling step can be further comprised of displacing the first fluid dielectric from a throat portion of the horn antenna using either a gas or a second fluid dielectric. In either case, the gas or second fluid dielectric can advantageously have at least one of a permittivity and a permeability different from the first fluid dielectric.

If a second fluid dielectric is used, the first and second fluid dielectrics can be selected so as to be immiscible, thereby forming an immiscible fluid interface between the first fluid dielectric and the second fluid dielectric. The first fluid dielectric can be communicated from at least one reservoir of a fluid management system to a throat portion of the horn and the second fluid dielectric can be communicated from a second reservoir to the throat portion of the horn.

DETAILED DESCRIPTION OF THE PREFERRED EMBODIMENTS

Figure 1:
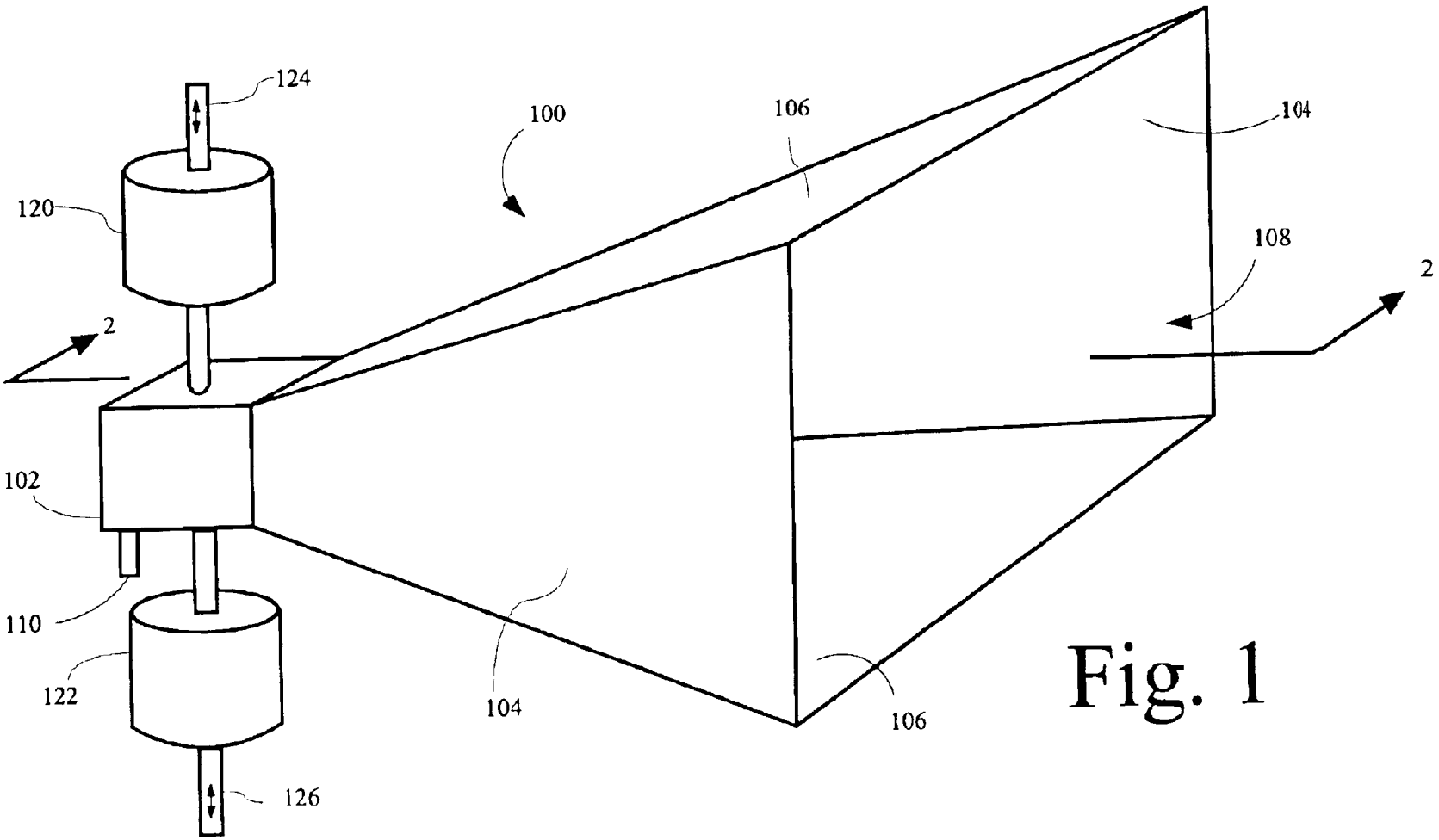
FIG. 1 is a perspective view of an electromagnetic horn antenna that is useful for understanding the invention.

The present invention concerns electromagnetic horn antennas that can be dynamically shifted from a first operational band of frequencies to a second operational band of frequencies. FIG. 1, is a drawing illustrating a dielectrically loaded horn 100. The horn 100 is of the pyramidal type, but it should be appreciated that the invention is not so limited, Instead, the invention can be implemented in any type of horn antenna. For example, the horn could also be of various other configuration including sectoral E-plane (E-plane flare), sectoral H-plane (H-plane flare) or exponentially tapered variety.

The horn is comprised of a throat portion 102 that is dimensioned for operating as a waveguide, and an aperture 108 disposed at an opposite end of the horn, opposed to the throat portion. The horn also includes vertical sidewalls 104 and horizontal sidewalls 106 that together form a flared section of the horn. In accordance with conventional waveguide designs, at least an inner surface of the horizontal and vertical sidewalls 104, 106 can be formed of an electrically conductive material. The horn can also have a variety of different flare angles and lengths, depending upon the gain and beam width needed in a particular application.

A suitable feed structure 110 is preferably provided for exciting the waveguide as shown. The types of exciters that are used for waveguide horns are typically the same as used for waveguide. Almost all rely on a wire probe in a cavity placed at the throat of the horn. The general approach to design of coax to waveguide adaptors is to introduce a wire probe shaped in such a way as to excite the desired mode in the waveguide (or horn). This can be a linear wire parallel to the electric fields of the desired mode, or a loop transverse to the magnetic fields of the desired mode. Any such discontinuity in the waveguide structure will result in the excitation of multiple modes. Excitation of undesired modes can be minimized by positioning the probe where the fields of the undesired modes are zero. For instance, even order modes typically have a zero at the center of the waveguide, so a probe placed at the center of the guide will preferentially excite odd order modes.

The most prevalent way to control modes, however, is with frequency. The TE and TM modes supported in waveguide are frequency dependent; each mode will only propagate above a certain frequency called the cutoff frequency. The cutoff frequency is different for each mode. If the modes are sorted in increasing order of cutoff frequency, then the mode with the lowest cutoff frequency is called the first mode, the mode with the next highest is called the second, and so on. There is a frequency range, between the cutoff of the first mode and the cutoff of the second mode, in which only the first mode will propagate. This characteristic influences the design of horns.

Cutoff frequency scales inversely with the size of the guiding structure. The larger the waveguide dimensions, the lower the cutoff frequency. Thus, for a given frequency, the horn will support many more modes at the aperture, where it is large, than at the throat, where it is small. This means that undesired modes are preferably suppressed within the throat of the horn, or they will propagate at the aperture and will be radiated. Uncontrolled generation of modes generally has undesirable effects on the far field radiation pattern. Notably, the need to suppress undesired modes at the throat of the horn will generally constrains the dimensions of the throat section. Accordingly, a method of dynamically varying the effective size of the neck could allow single mode excitation of the horn over a broader frequency range.

One way dynamically vary the effective electrical size of the throat portion of a horn antenna is to load the horn at the throat with dielectric material. Electrically, the effect is make the horn feed behave as if it were physically larger. The effective increase is proportional to the square root of the effective permittivity and permeability of the material. Either permittivity or permeability can be changed, but a preferred approach is to vary both in proportion, which will maintain a constant wave impedance (note wave impedance is not the same as waveguide impedance) in the loaded and unloaded portions of the horn.

Accordingly, the waveguide horn 100 preferably has one or more fluid reservoirs 120, 122 that are preferably in fluid communication with the throat portion 102 of the horn by way of conduit sections 128, 130 respectively. The fluid reservoirs 120, 122 can contain at least one fluid dielectric. Fluid actuators 124, 126 are provided for selectively controlling the movement of the fluid dielectric in each reservoir into and out of the throat portion 102 of the horn. The fluid actuators can be controlled manually or, in a preferred embodiment, can be operated automatically in response to a control signal. In that case, the fluid actuator can be operated by an appropriate electromechanical, pneumatic, or hydraulic device. For example a remotely operated stepper motor or electric solenoid could be used for this purpose. Any of devices can be operated by means of a suitable control signal appropriate for the device.

Figure 2A:
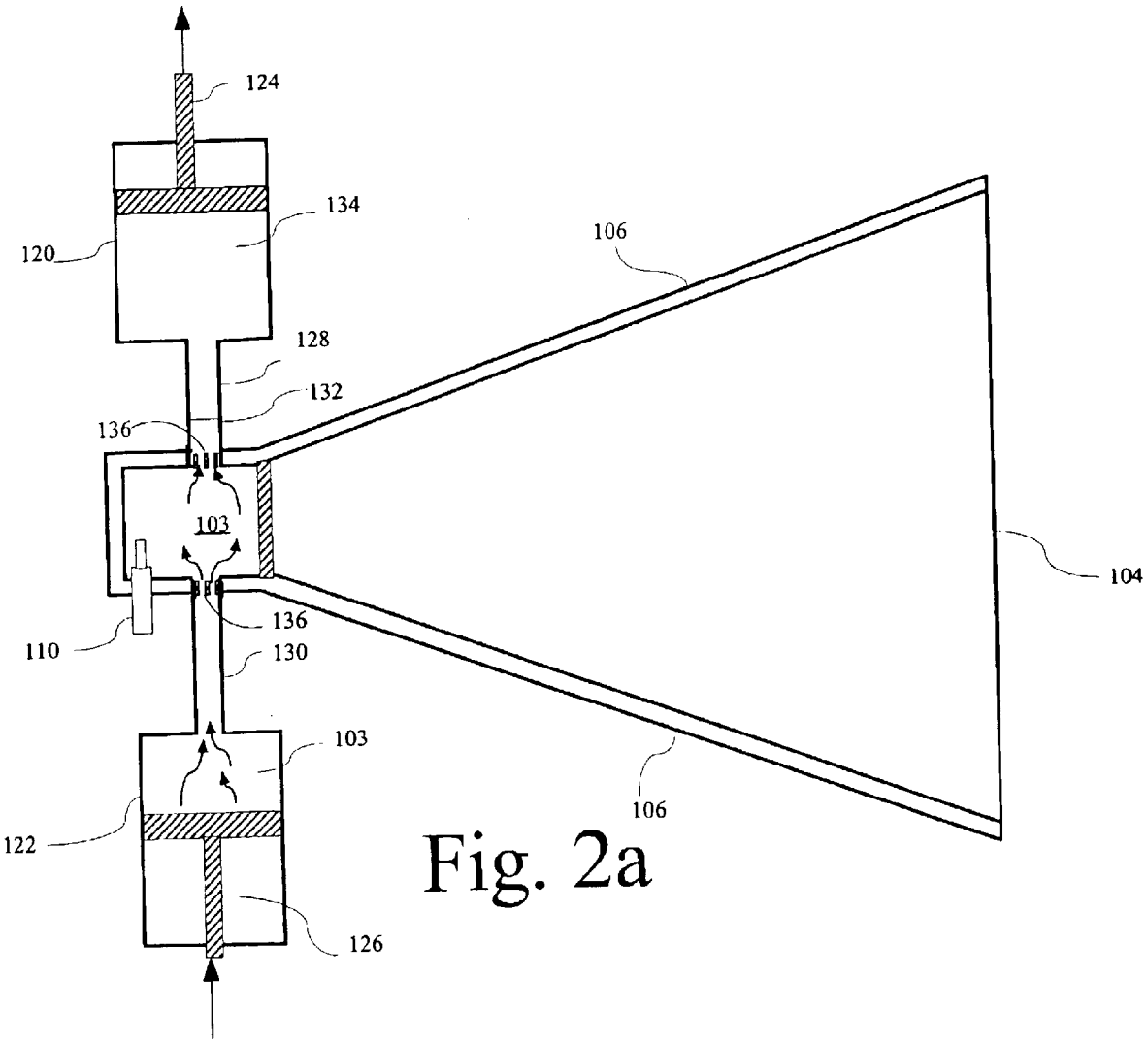
FIG. 2*a* is a cross-sectional view of the electromagnetic horn antenna of FIG. 1 taken along line 2—2 in a first mode of operation.

Referring now to FIG. 2*a*, a cross-sectional view of the horn 100 is shown taken along line 2—2 in FIG. 1. FIG. 2*a* represents one possible arrangement of fluid reservoirs, conduits, and fluid actuators that could be used to control the movement of fluid into and out of the throat portion 102. However, it should be understood that many other alternative arrangements are also possible for controlling the fluid dielectric within the intended scope of the invention.

As illustrated in FIG. 2*a*, the horn 100 is preferably provided with a dielectric wall 112 between the throat portion 102 and flared section of the horn. The dielectric wall 112 provides a seal that prevents dielectric fluid 103 contained within the throat portion 102 from escaping into the flared portion of the horn. According to a preferred embodiment, the dielectric wall can have a relative permittivity that is close to 1. However, the invention is not so limited, and other values of relative permittivity are also possible. The exact position of the dielectric wall can is not critical. For example, the wall can be positioned generally at the junction between the throat and the flared portion of the horn, but it is also acceptable to select a location for the wall which is situated somewhat further within the throat or slightly outside the throat so as to be closer to the horn aperture. The practical effect of changing the position of the wall in this way could potentially include better control of undesired modes and it could result in shortening the throat portion of the horn. In this regard it may be noted that a horn can be considered as the limiting case of a series of stepped waveguides—the horn can be regarded at any point along its length as a waveguide. Control of undesired modes can be done at any point, but it is desirable (and generally easier) to do it close to the throat. Conductive screens 136 can be provided at fluid ports along the walls of the throat portion 102. The conductive screens allow the free flow of fluid into and out of the throat portion 102 of the horn while also preventing the leakage of RF into the conduits.

Note that there may be some instances where it would be desirable that one or more wall of the throat be curved. There may also be situations in which it would be useful to divide the region 103 into several zones (i.e. more than one dielectric wall) so as to permit the fluid content in each zone to be controlled separately. One such situation might be to provide a stepped transition of wave impedance, which may be necessary if fluids are not available or practical for some desired permittivity and permeability.

The fluid actuators 124, 126 can be used to add and remove fluid dielectric 103 from the throat portion 102 of the horn. According to one embodiment of the invention, the horn can have at least two operating modes. In one mode, the fluid dielectric 103 can be present in the throat portion 102 and in a second mode the fluid dielectric 103 can be removed from the throat portion and can be replaced by a gas 134 (such as air) that is preferably non-reactive with the fluid dielectric. The fluid dielectric can be selectively moved into or out of the throat portion using the fluid actuators 124, 126. The advantage of the dual operating mode is that by controlling the presence and removal of the fluid dielectric from the throat portion 102, it is possible to change the operational frequency range of the horn.

The operating frequency range of the horn 100 will be determined primarily by the dimensions of the throat portion 102. Throat portion 102 operates essentially in the manner of a waveguide and therefore has similar dimensional constraints that are necessary for proper operation. The practical upper frequency limit of operation for a horn antenna is limited by the occurrence of higher order modes of propagation which can adversely affect the radiation pattern produced by the horn. Since the throat portion 102 of the horn antenna essentially behaves as a waveguide, the occurrence of these higher order modes are determined by the dimensions of the throat portion 102 and the feed system. Generally speaking, it is preferred that the horn be operated at a frequency that is below this upper limit to avoid distortions in the radiation pattern.

The lower frequency limit of operation for the horn is also determined by the dimensions of the throat portion 102. Below a certain frequency, the dimensions of the throat will be too small and the lowest order mode is said to be cut off. The net result is that the RF at that frequency will no longer propagate within the throat of the horn.

Figure 2B:
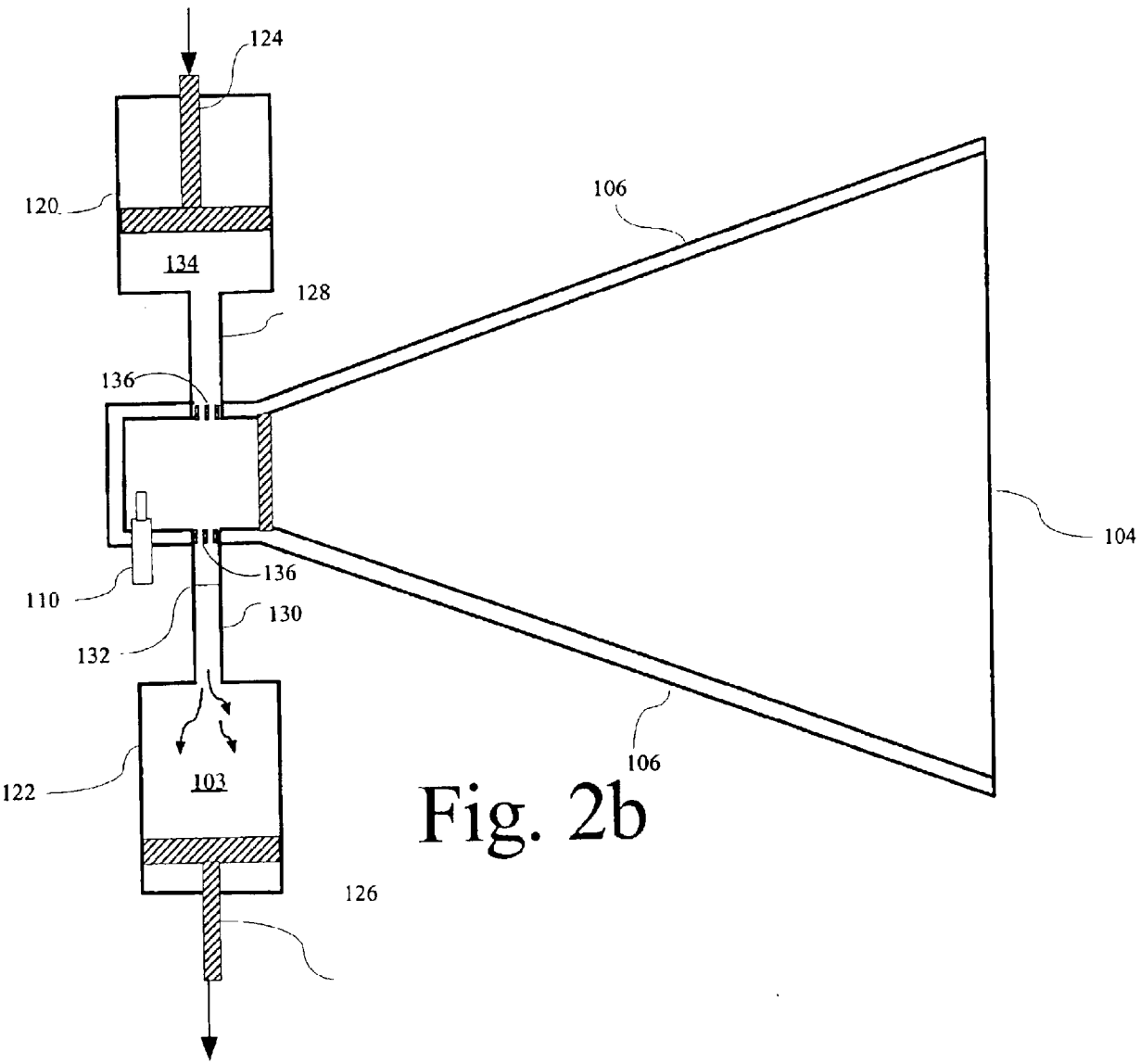
FIG. 2*b* is a cross-sectional view of the electromagnetic horn antenna of FIG. 1 taken along line 2—2 in a second mode of operation.

The presence of the fluid dielectric in the throat portion 102 can dynamically lower the cut-off frequency of the horn 100. Thus, the ability to selectively add and remove the fluid dielectric means that a single horn 100 can be used for two different frequency bands. When the dielectric fluid 103 is present in the throat 102 of the horn, the horn will operate on a lower frequency band as compared to when the throat portion 102 is purged of the dielectric fluid, provided that the dielectric fluid has a relative permittivity that is greater than 1. In FIG. 2*a*, the fluid 103 is shown being moved upwardly into the throat portion 102 from the fluid reservoir 122 as a result of the operation of the actuator 126. Consequently, the fluid dielectric 103 is moved upwardly to fill the throat portion 102. An inteface 132 between the fluid dielectic and the gas or air 134 moves upwardly in FIG. 2*a* as fluid dielectric 103 fills the throat portion 102 and the air or gas 134 is pushed out. The process can be accommodated or aided by the movement of the second fluid actuator 124 as shown, which can be used to create a partial vacuum in throat portion 102, and thereby help to draw into the fluid dielectric into the throat portion. FIG. 2*b* illustrates the second mode of operation in which the fluid dielectric 103 is purged from the throat portion 102 by the movement of the fluid actuators 124, 126 in a direction opposite to that which is illustrated in FIG. 2*a*.

According to an alternative embodiment, the gas 134 can be replaced by a second dielectric fluid that is immiscible with the dielectric fluid 103. In that case, the invention can operate in accordance with the same principles as described above relative to FIGS. 2*a* and 2*b*, but the interface 132 will be an immiscible fluid interface instead of an interface between the air/fluid dielectric interface. One example of immiscible fluids that could be used for this purpose would be an oil based fluid dielectric and a water based fluid dielectric, each modified appropriately to produce a relative permittivity and permeability suitable for achieving horn operation on a different frequency band of interest.

Figure 2C:
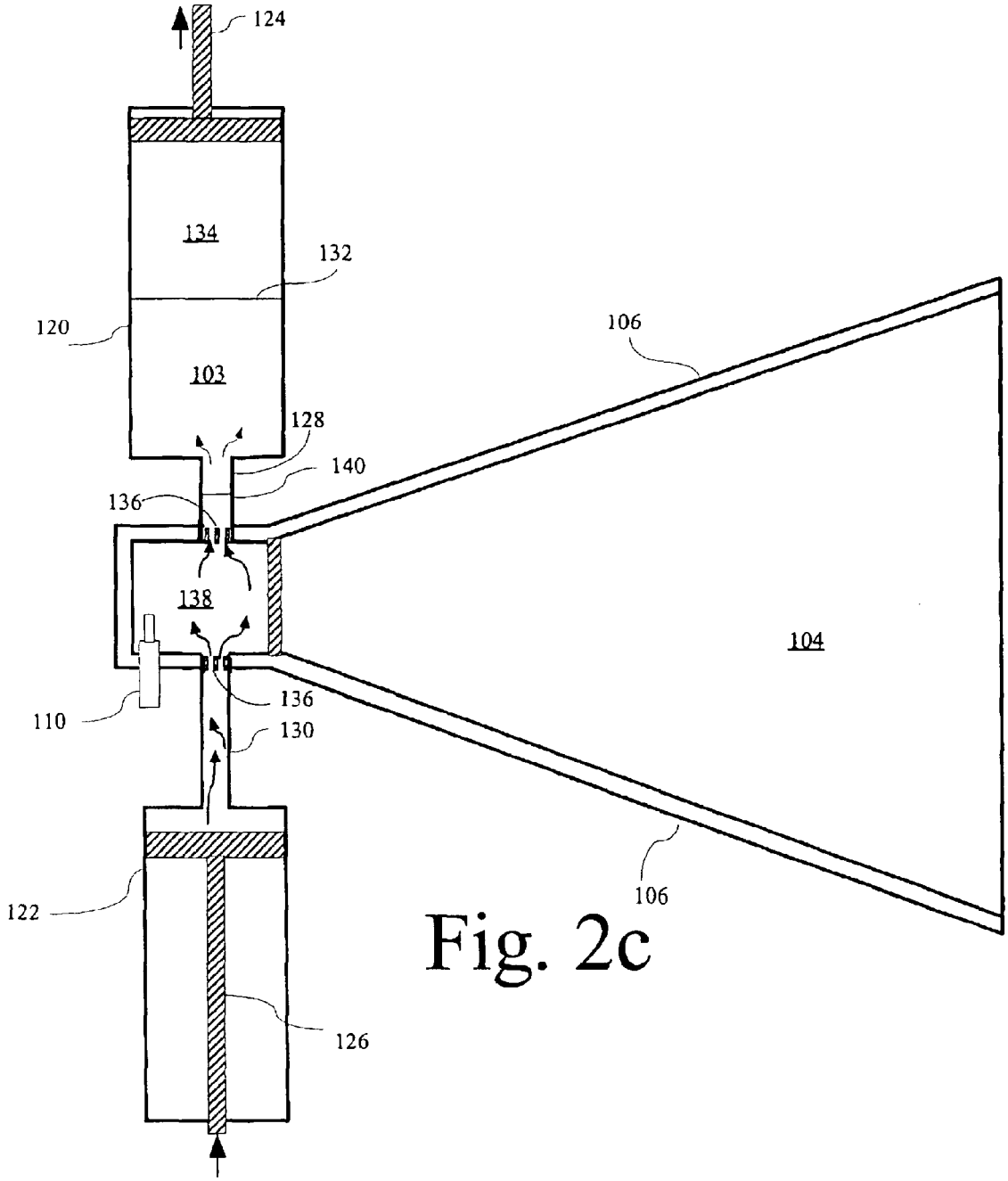
FIG. 2*c* is an alternative embodiment of the electromagnetic horn antenna of FIG. 1 taken along line 2—2 in a first mode of operation.

Referring now to FIG. 2*c*, an embodiment of the invention is shown in which two immiscible fluid dielectrics 103, 138 are used to control the operational frequency limits of the horn. An immiscible fluid interface 140 separates the two fluid dielectrics. Several immiscible fluid candidates exist. Examples are Fomblin and Acetone as well as Lord 336AG and Deionized Water.

Figure 2D:
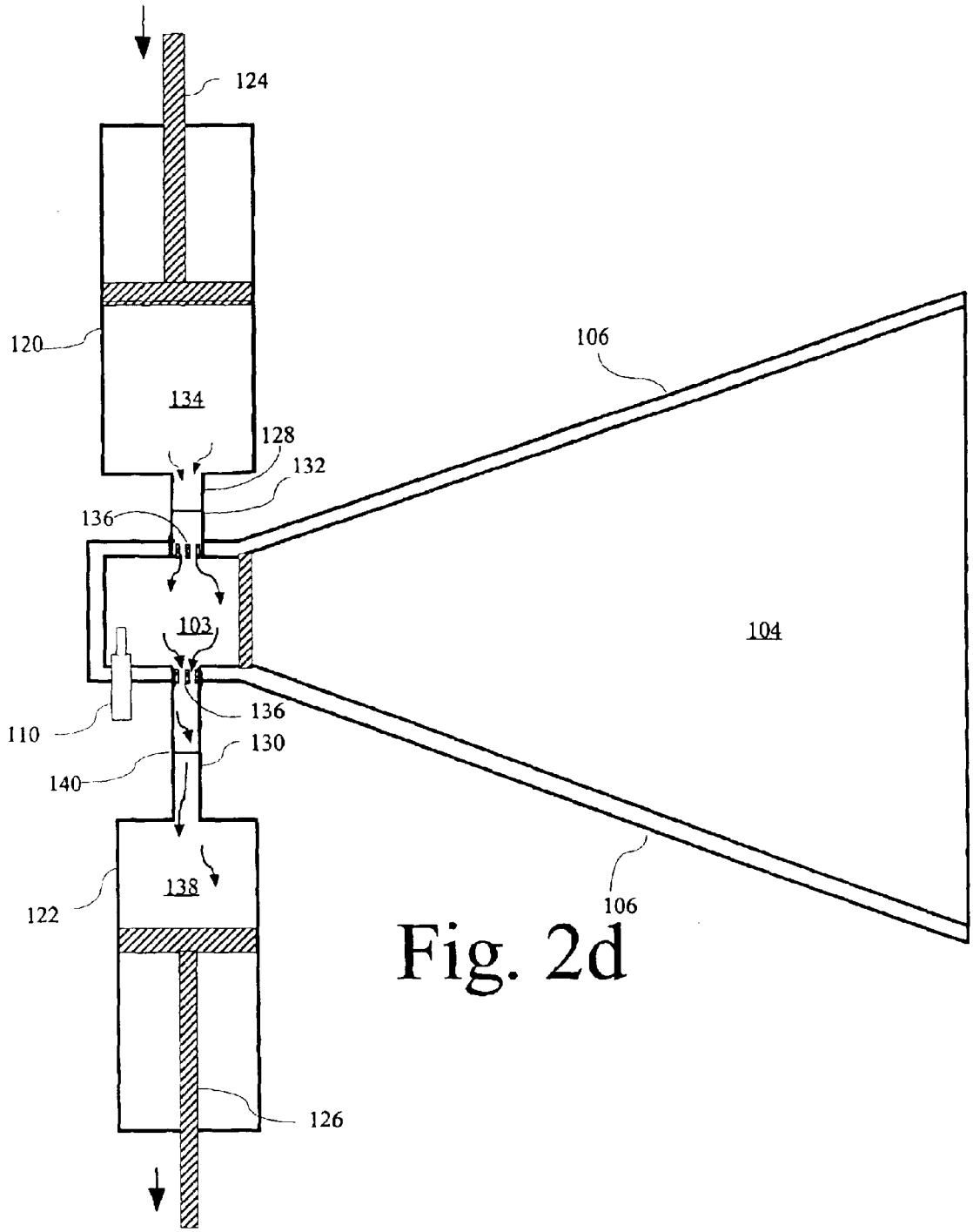
FIG. 2*d* is a cross-sectional view of the electromagnetic horn antenna of FIG. 2*c* in a second mode of operation.
Figure 2E:
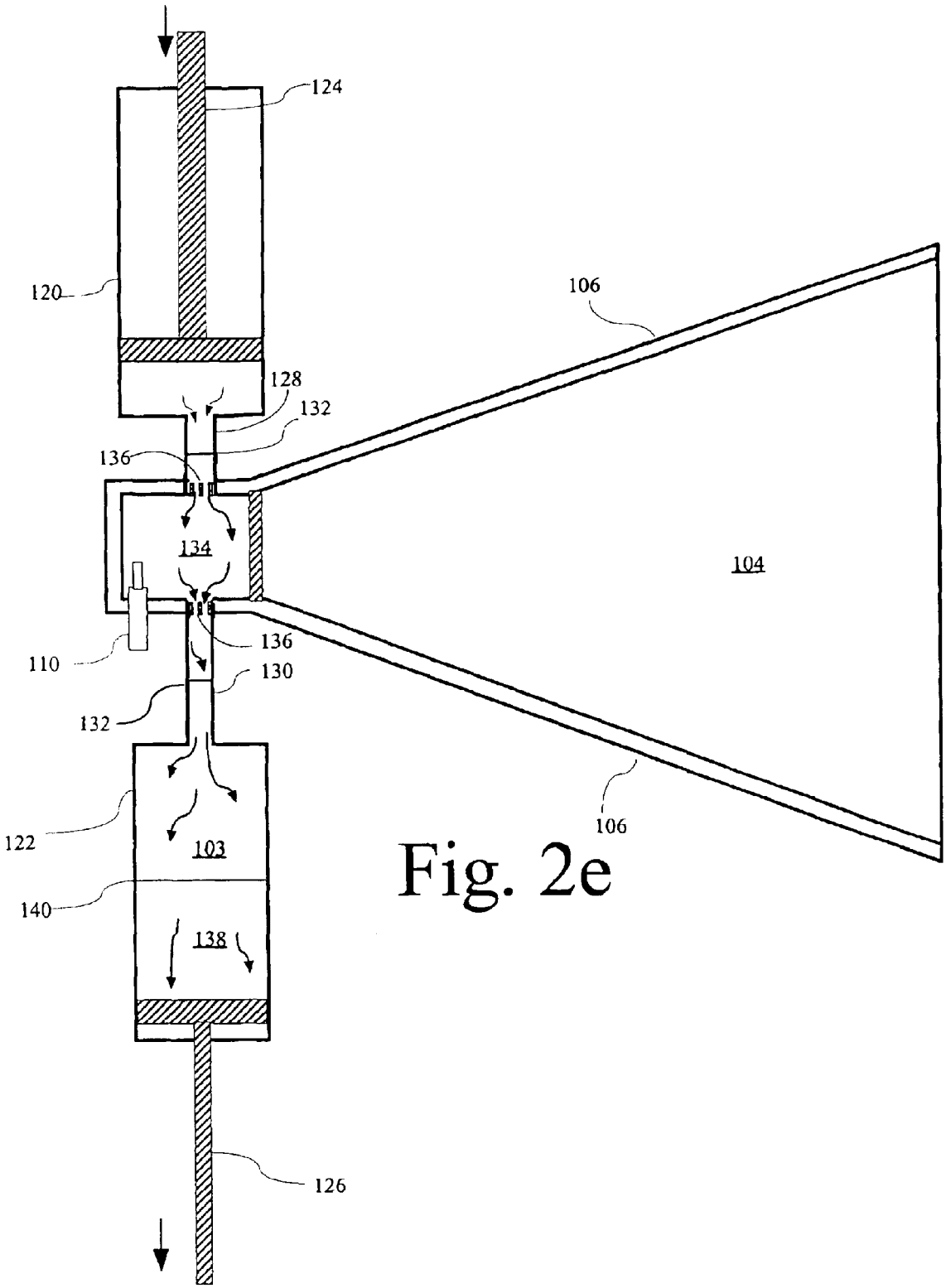
FIG. 2*e* is a cross-sectional view of the electromagnetic horn antenna of FIG. 2*c* in a third mode of operation.

In addition, air or gas 134 can be provided as previously described in relation to the embodiment of FIG. 1. In the embodiment shown in FIG. 2*c*, three separate operating bands can be achieved for a single horn antenna by selectively filling the horn throat portion with gas 134, a first fluid dielectric 103 or a second fluid dielectric 138. In FIG. 2*c*, the throat is filled with a fluid dielectric 138. In FIG. 2*d*, the throat of the horn is filled with fluid dielectric 103. Finally in FIG. 2*e*, the throat of the horn is filled with gas 134. Those skilled in the art will appreciate that more than two types of fluid dielectric can be used to achieve additional operating bands, provided that the adjacent types of fluid dielectric are immiscible.

Those skilled in the art will readily appreciate that the invention is not limited to any specific method for modifying the fluid dielectric load contained within the throat of the horn. For example, the composition of a fluid dielectric could be modified by dynamically mixing various components together for operating the horn on a particular operating band. The fluid could be then be replaced with a different dynamically mixed composition or mixture of fluid for operating on a different band.

Efficiency Considerations

It is anticipated that some horn efficiency may be lost as a result of using a fluid dielectric that has a relative permittivity that is greater than 1. The loss in efficiency can be attributed to the impedance mismatch between the fluid dielectric and the air interface that will have a relative permittivity of approximately 1. In order to overcome this limitation, the fluid dielectric 103, 138 can also be prepared so as to have a relative permeability that is larger than 1. Maintaining the fluid dielectric with a constant ratio of relative permeability to relative permittivity has been found to help improve the impedance mismatch which can otherwise occur at the boundary between dielectrics having different values of relative permittivity.

Composition of the Fluid Dielectric

Each of the first and second fluid dielectrics can be comprised of any fluid composition having the required characteristics of permittivity and permeability as may be necessary for achieving a selected range of frequency operation. Those skilled in the art will recognize that one or more component parts can be mixed together to produce a desired permeability and permittivity required. In fact, aside from the desirability for the fluid dielectrics be immiscible if two or more fluid dielectrics are used, there are relatively few limits on the range of materials that can be used to form the fluidic dielectric. Accordingly, those skilled in the art will recognize that the examples of suitable fluidic dielectrics as shall be disclosed herein are merely by way of example and are not intended to limit in any way the scope of the invention. Also, while component materials can be mixed in order to produce the first and second fluidic dielectrics as described herein, it should be noted that the invention is not so limited. Instead, the composition of the first and second fluidic dielectrics could be formed in other ways. All such techniques will be understood to be included within the scope of the invention.

Those skilled in the art will recognize that a nominal value of permittivity ($\epsilon_1$) for fluids is approximately 2.0. However, the fluidic dielectrics used herein can include fluids with higher values of permittivity. For example, the first or second fluid dielectrics 103, 138 could be selected to have a permittivity values of between 2.0 and about 58, depending upon the frequency bands of interest. Similarly, the fluid dielectric compositions can have a wide range of permeability values.

High levels of magnetic permeability are commonly observed in magnetic metals such as Fe and Co. For example, solid alloys of these materials can exhibit levels of $\mu$, in excess of one thousand. By comparison, the permeability of fluids is nominally about 1.0 and they generally do not exhibit high levels of permeability. However, high permeability can be achieved in a fluid by introducing metal particles/elements to the fluid. For example typical magnetic fluids comprise suspensions of ferro-magnetic particles in a conventional industrial solvent such as water, toluene, mineral oil, silicone, and so on. Other types of magnetic particles include metallic salts, organo-metallic compounds, and other derivatives, although Fe and Co particles are most common. The size of the magnetic particles found in such systems is known to vary to some extent. However, particles sizes in the range of 1 nm to 20 $\mu$m are common. The composition of particles can be selected as necessary to achieve the required permeability in the final fluidic dielectric. Magnetic fluid compositions are typically between about 50% to 90% particles by weight. Increasing the number of particles will generally increase the permeability.

Examples of fluid dielectrics could include a hydrocarbon dielectric oil such as Vacuum Pump Oil MSDS-12602 to realize a low permittivity, low permeability fluid, low electrical loss fluid. A low permittivity, high permeability fluid may be realized by mixing same hydrocarbon fluid with magnetic particles such as magnetite manufactured by FerroTec Corporation of Nashua, N.H., or iron-nickel metal powders manufactured by Lord Corporation of Cary, N.C. for use in ferrofluids and magnetoresrictive (MR) fluids. Additional ingredients such as surfactants may be included to promote uniform dispersion of the particle. Fluids containing electrically conductive magnetic particles require a mix ratio low enough to ensure that no electrical path can be created in the mixture. Solvents such as formamide inherently posses a relatively high permittivity. Similar techniques could be used to produce fluidic dielectrics with higher permittivity. For example, fluid permittivity could be increased by adding high permittivity powders such as barium titanate manufactured by Ferro Corporation of Cleveland, Ohio. For broadband applications, the fluids would not have significant resonances over the frequency band of interest.

We claim:

1. An electromagnetic horn antenna, comprising:

a throat portion;

an aperture disposed at an end of the horn opposed to said throat portion;

a flared section disposed between said throat portion and said aperture, at least one dimension of said flared section increasing in size along an axial length of said horn defined between said throat portion and said aperture; and a dielectric load disposed within said throat portion, said dielectric load comprised of at least one fluid dielectric; and a fluid management system capable of selectively controlling said dielectric load to vary at least one of a load permeability and a permittivity.

2. The electromagnetic horn antenna according to claim 1 wherein said dielectric load further comprises a gas that is non-reactive with said fluid dielectric.

3. The electromagnetic horn antenna according to claim 2 wherein said gas has at least one of a relative permeability and a relative permittivity different from said fluid dielectric.

4. The electromagnetic horn antenna according to claim 3 further comprising a second fluid dielectric having electromagnetic properties distinct from said first fluid dielectric.

5. The electromagnetic horn antenna according to claim 4 wherein said first and second fluid dielectrics are immiscible.

6. The electromagnetic horn antenna according to claim 4 wherein said first and second fluid dielectrics are separated by an immiscible fluid interface.

7. The electromagnetic horn antenna according to claim 1 further comprising a second fluid dielectric having electromagnetic properties distinct from said first fluid dielectric.

8. The electromagnetic horn antenna according to claim 1 wherein said fluid management system comprises at least one fluid reservoir in fluid communication with said throat portion.

9. The electromagnetic horn antenna according to claim 1 further comprising a first fluid port communicating said first fluid dielectric from a fluid reservoir to said throat portion and a second fluid port communicating a second fluid dielectric from a second reservoir to the throat portion, and an immiscible fluid interface separating said first and second fluid dielectrics.

10. The electromagnetic horn antenna according to claim 1 wherein said first fluid dielectric is comprised of an industrial solvent.

11. The electromagnetic horn antenna according to claim 1 wherein said first fluid dielectric is comprised of a suspension of magnetic particles.

12. The electromagnetic horn antenna according to claim 11 wherein said magnetic particles are formed of a material selected from the group consisting of a metal, ferrite, metallic salts, and organo-metallic particles.

13. The electromagnetic horn antenna according to claim 1 further comprising at lest one of a hydraulic, pneumatic and an electromechanical device for selectively controlling said dielectric load in response to a control signal.

14. A method for selectively varying a cutoff frequency of an electromagnetic horn antenna, comprising the steps of:

dielectrically loading said horn with a dielectric load comprising a first fluid dielectric;

selectively controlling said dielectric load by varying at least one of a dielectric load permeability and a load permittivity.

15. The method according to claim 14 wherein said selectively controlling step is further comprised of selectively moving said first fluid dielectric into and out of a throat portion of said horn antenna to select an operating band.

16. The method according to claim 14 wherein said selectively controlling step is further comprised of displacing said first fluid dielectric from a throat portion of said horn antenna with a gas.

17. The method according to claim 16 further comprising the step of selecting said fluid dielectric to have at least one of a permittivity and a permeability different from said gas.

18. The method according to claim 14 wherein said selectively controlling step is further comprised of displacing said first fluid dielectric from a throat portion of said horn antenna with a second fluid dielectric.

19. The method according to claim 18 further comprising the step of selecting said first fluid dielectric to have at least one of a relative permeability and a relative permittivity different from said second fluid dielectric.

20. The method according to claim 18 further comprising the step of forming an immiscible fluid interface between said first fluid dielectric and said second fluid dielectric.

21. The method according to claim 14 further comprising the step of selecting said first and second fluid dielectrics to be comprised of immiscible fluids.

22. The method according to claim 14 further comprising the step of communicating said first fluid dielectric from at least one reservoir of a fluid management system to a throat portion of said horn.

23. The method according to claim 22 further comprising the step of communicating said second fluid dielectric from a second reservoir to said throat portion of said horn.

24. The method according to claim 23 further comprising the step of selecting said first and second fluid dielectrics to be based on immiscible fluids.

25. The method according to claim 14 further comprising the step of selecting said first fluid dielectric to be comprised of an industrial solvent.

26. The method according to claim 14 further comprising the step of selecting a component of said first fluid dielectric to include a suspension of magnetic particles.

27. The method according to claim 26 further comprising the step of selecting said magnetic particles from the group consisting of a metal, ferrite, metallic salts, and organo-metallic particles.

28. A method for dynamically varying the effective electrical size of a throat of an electromagnetic horn antenna to allow single mode excitation of the horn over a broad frequency range, comprising the steps of:

dielectrically loading said horn with a dielectric load comprising a first fluid dielectric;

selectively controlling said dielectric load by varying at least one of a dielectric load permeability and a load permittivity.

29. The method according to claim 28 wherein said selectively controlling step is further comprised of selectively moving said first fluid dielectric into and out of a throat portion of said horn antenna.

30. The method according to claim 28 wherein said selectively controlling step is further comprised of selectively controlling a volume of said first fluid dielectric contained in a throat portion of said horn antenna.

31. The method according to claim 28 wherein said selectively controlling step is further comprised of selectively controlling a composition of said first fluid dielectric contained in a throat portion of said horn antenna.

* * * * *